US008130192B2

(12) United States Patent
Feng

(10) Patent No.: US 8,130,192 B2
(45) Date of Patent: Mar. 6, 2012

(54) METHOD FOR REDUCING IMAGE ARTIFACTS ON ELECTRONIC PAPER DISPLAYS

(75) Inventor: Guotong Feng, Mountain View, CA (US)

(73) Assignee: Ricoh Co., Ltd., Tokyo (JP)

( * ) Notice: Subject to any disclaimer, the term of this patent is extended or adjusted under 35 U.S.C. 154(b) by 1262 days.

(21) Appl. No.: 11/764,076

(22) Filed: Jun. 15, 2007

(65) Prior Publication Data

US 2008/0309953 A1 Dec. 18, 2008

(51) Int. Cl.
*G09G 3/34* (2006.01)

(52) U.S. Cl. ..... 345/107; 345/87; 345/89; 345/204; 358/3.03; 358/3.06; 358/534; 358/536

(58) Field of Classification Search ..... 345/76, 345/77, 107, 589, 690, 87–89, 204; 358/1.9, 358/1.13, 1.15, 3.03, 3.06, 3.21, 518, 535, 358/13.03, 534, 536
See application file for complete search history.

(56) References Cited

U.S. PATENT DOCUMENTS

| | | | | |
|---|---|---|---|---|
| 5,543,855 | A | 8/1996 | Yamada et al. | |
| 6,426,802 | B1 * | 7/2002 | Lin | 358/1.9 |
| 2002/0122210 | A1 * | 9/2002 | Mitchell Ilbery | 358/3.04 |
| 2005/0122564 | A1 * | 6/2005 | Zehner et al. | 359/296 |
| 2005/0157791 | A1 * | 7/2005 | Sun | 375/240.16 |
| 2006/0061541 | A1 * | 3/2006 | Ou et al. | 345/107 |
| 2007/0133060 | A1 * | 6/2007 | Cittadini et al. | 358/3.06 |

FOREIGN PATENT DOCUMENTS

| | | | |
|---|---|---|---|
| EP | 0581594 | A2 | 7/1993 |
| EP | 0576174 | A1 | 12/1993 |
| EP | 0 581 594 | | 2/1994 |
| WO | WO 00/65567 | | 11/2000 |
| WO | WO 2005/109384 | A2 | 11/2005 |

OTHER PUBLICATIONS

Chinese Office Action for corresponding Chinese Patent Application No. 200880000564.8, May 25, 2010, 4 pgs. English Translation Provided.
PCT International Search Report dated Sep. 16, 2008, for Application No. PCT/JP08/061270, filed Jun. 13, 2008, 3 pages.
Written Opinion of the International Searching Authority dated Sep. 16, 2008, for Application No. PCT/JP08/061270, filed Jun. 13, 2008, 4 pages.
Zehner et al., "20.2 Drive Waveforms for Active Matrix Electrophoretic Displays", 2003 International Symposium Digest of Technical Papers, May 20, 2003, pp. 842-845, vol. XXXIV, San Jose, CA, USA.
Sun, "Video Halftoning", IEEE Transactions on Image Processing, Mar. 31, 2006, pp. 678-686, vol. 15, No. 3, IEEE Service Center, Piscataway, New Jersey, USA.
European Search Report for corresponding European Patent Application No. 08777420.4, May 24, 2011, 11 pgs.

* cited by examiner

*Primary Examiner* — Quan-Zhen Wang
*Assistant Examiner* — Jennifer Nguyen
(74) *Attorney, Agent, or Firm* — Blakely, Sokoloff, Taylor & Zafman LLP

(57) ABSTRACT

A method and apparatus for reducing image artifacts on displays (e.g., electronic paper, etc.) are described. In one embodiment, the method comprises generating pixels of an image for a bistable display using halftoning based on data of one or more previously displayed images.

32 Claims, 10 Drawing Sheets

METHOD FOR REDUCING IMAGE ARTIFACTS ON ELECTRONIC PAPER DISPLAYS

FIELD OF THE INVENTION

The present invention relates to the field of image processing; more specifically, the present invention relates to performing image processing to reduce artifacts on bistable displays (e.g., electrophoretic displays) or other displays that have similar characteristics to bistable displays.

BACKGROUND OF THE INVENTION

Electrophoretic displays are known as promising technology for electronic paper applications and future generations of smart handheld devices, where paper-like appearance, good readability under various lighting conditions, and ultra-low power consumption are desirable. Many electrophoretic displays, such as E ink microencapsulated electrophoretic displays (MEPs), are capable of high resolution (e.g. 800×600 or above), and can be built using conventional active matrix TFT arrays that are similar to those used in LCDs, where 50 Hz (20 ms per frame) frame rate is commonly used.

However, the electro-optic characteristic of electronic ink transition states in many electrophoretic displays such as E Ink MEPs requires a minimum frame update rate of 200 Hz (5 ms per frame) in order to achieve 1 L* lightness resolution, where 1 L* represents a just noticeable difference in lightness in CIELAB (CIE 1976 L*a*b*) color space. This frame update rate is impractical for high-resolution active matrix displays nowadays. Therefore, on a 50 Hz frame rate display, previous image ghosting can appear on the screen when lightness difference larger than 1 L* occurs at pixels with the same current gray level state but different previous gray level states. FIG. 1 illustrates the lightness mismatch at two regions on an electronic ink display.

Referring to FIG. 1, the previous image is a black letter "O" with white background, and the current image is a black letter "T" with light gray background. The transitions from black to light gray and from white to light gray create a human being noticeable difference in lightness, which appears as unwanted previous image ghosting artifacts.

FIG. 2 illustrates more details of why ghosting occurs by showing the pulse width and the lightness response for different gray state transitions in an electronic display. Essentially, ghosting is a display quantization error of lightness between two transition states due to limited resolution of pulse width. As shown in FIG. 2, the width of 1 frame is the minimum unit of each pulse width, and is limited by the display frame rate (typically 50 Hz).

Ghosting is an unfavorable characteristic of electronic ink switching states in electrophoretic displays, and introduces severe imaging artifacts on the screen. To address this problem, one solution is to design optimized waveforms for the display controllers to drive the electronic state transitions. The desired impulse width is modulated by changing the sequence of driving pulses. FIG. 3 illustrates two types of waveforms from E Ink displays, direct and indirect waveforms, which are used to control the transition from dark gray to light gray on an electronic ink display. The direct waveform produces the least accuracy, i.e., worst ghosting artifacts, and the indirect waveform produces better accuracy, but requires flashiness which is also not a favorable appearance on the screen. Although the indirect waveforms can be optimized through measurements and electro-optical model prediction, there always exists a contradiction between flashiness and accuracy. Essentially, this approach is highly constrained by the impulse width resolution, which is set by the frame update rate in the pulse width modulation case described above. For more information, see Zehner, et al., "Drive Waveforms for Active Matrix Electrophoretic Displays," Digest of Technical papers, SID Symposium, 2003, pp. 842-845, and Amundson & Sjodin, "Achieving Graytone Images in a Microencapsulated Electrophoretic Display," Digest of Technical papers, SID Symposium, 2006, pp. 1918-1921.

It is also possible to achieve the desired impulse width by changing voltages. However, this would require more complicated display drivers that provide multiple voltages and, for these reasons, is an undesirable approach. Some different solutions exist for ghosting reduction from E Ink, all focusing on waveform tweaking with special driving pulses. For more information, see U.S. Patent Publication No. 20070080926A1, entitled "Method and Apparatus for Driving an Electrophoretic Display Device with Reduced Image Retention," PCT Application WO2005096259A1, entitled "An Electrophoretic Display with Reduced Cross Talk," and PCT Application WO2005050610A1, entitled "Method and Apparatus for Reducing Edge Image Retention in an Electrophoretic Display."

Although not previously used to address the problems discussed above, there are a number of prior art image processing techniques. These include traditional halftoning, spatiotemporal dithering, and video halftoning. Traditional halftoning works for printers and displays. However, all of these traditional halftoning methods only work in the spatial dimension, and none of these methods is designed for electrophoretic displays. For more information, see M. Analoui and J. P. Allebach, "Model-Based Halftoning Using Direct Binary Search," Proc. 1992 SPIE/IS&T Symposium on Electronic Imaging Science and Technology, Vol. 1666, San Jose, Calif., Feb. 9-14, 1992, pp. 96-108; B. Kolpatzik and C. A. Bouman, "Optimized Error Diffusion for Image Display," J. Electronic Imaging, Vol. 69, No. 10, pp. 1340-1349, October 1979.

Spatiotemporal dithering produces high intensity resolution on display devices with low intensity resolution by diffusing the gray level quantization error into the next frame of the image for display in both spatial dimension and temporal dimension. For more information, see U.S. Pat. No. 5,254,982, entitled "Error propagated image halftoning with time-varying phase shift," issued to Feigenblatt, et al., on Oct. 19, 1993; U.S. Pat. No. 6,714,206, entitled "Method and system for spatial-temporal dithering for displays with overlapping pixels," issued to Martin, et al., on Mar. 30, 2004; and J. B. Mulligan, "Methods for Spatio-Temporal Dithering," SID '93 Conference Digest, Seattle, Wash., May 17-21, 1993, pp. 155-158.

Video halftoning renders a digital video sequence onto display devices that have limited intensity resolutions and color palettes. The essential idea is to trade the spatiotemporal resolution for enhanced intensity and color resolution by diffusing the quantization error of a pixel to its spatiotemporal neighbors. This error diffusion process includes an one-dimensional temporal error diffusion and a two-dimensional spatial error diffusion, which are separable. For more information, see Z. Sun, "Video halftoning", IEEE Transaction on Image Processing, 15(3), pp. 678-86, March, 2006; and C. B. Atkins, T. J. Flohr, D. P. Hilgenberg, C. A. Bouman, and J. P. Allebach, "Model-based color image sequence quantization," in Proc. SPIE: Human Vision, Visual Processing, and Digital Display V, 1994, vol. 2179, pp. 310-309.

SUMMARY OF THE INVENTION

A method and apparatus for reducing image artifacts on displays (e.g., electronic paper, etc.) are described. In one embodiment, the method comprises generating pixels of an image for a bistable display using halftoning based on data of one or more previously displayed images.

DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
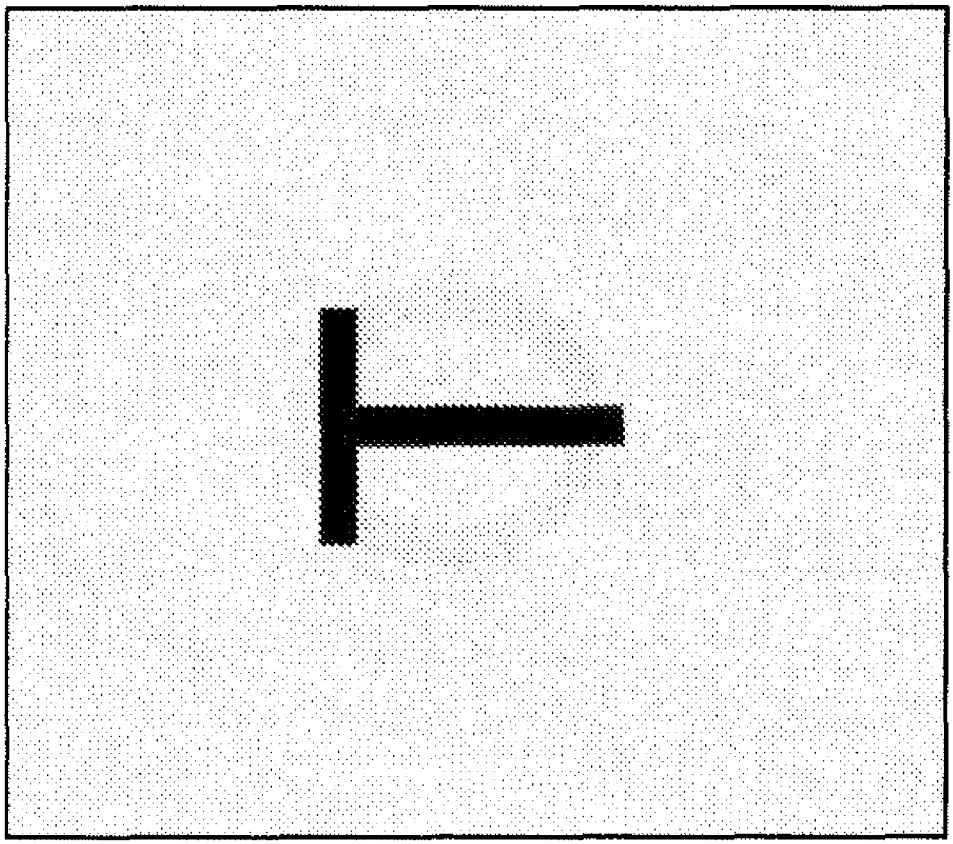
FIG. 1 illustrates lightness mismatch on a bistable display.
Figure 2:
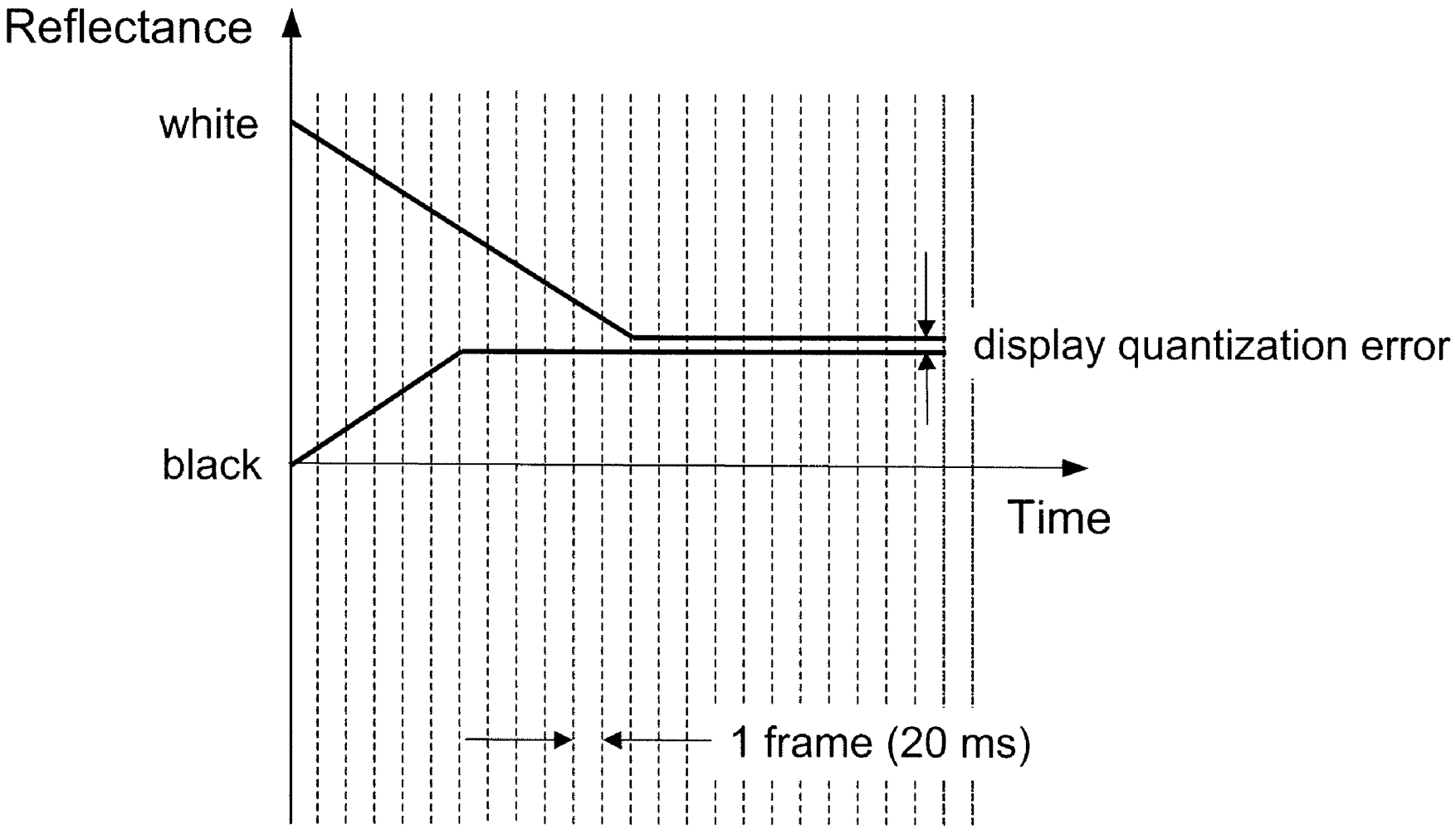
FIG. 2 illustrates reflectance response for gray level state transitions of electronic ink.
Figure 3:
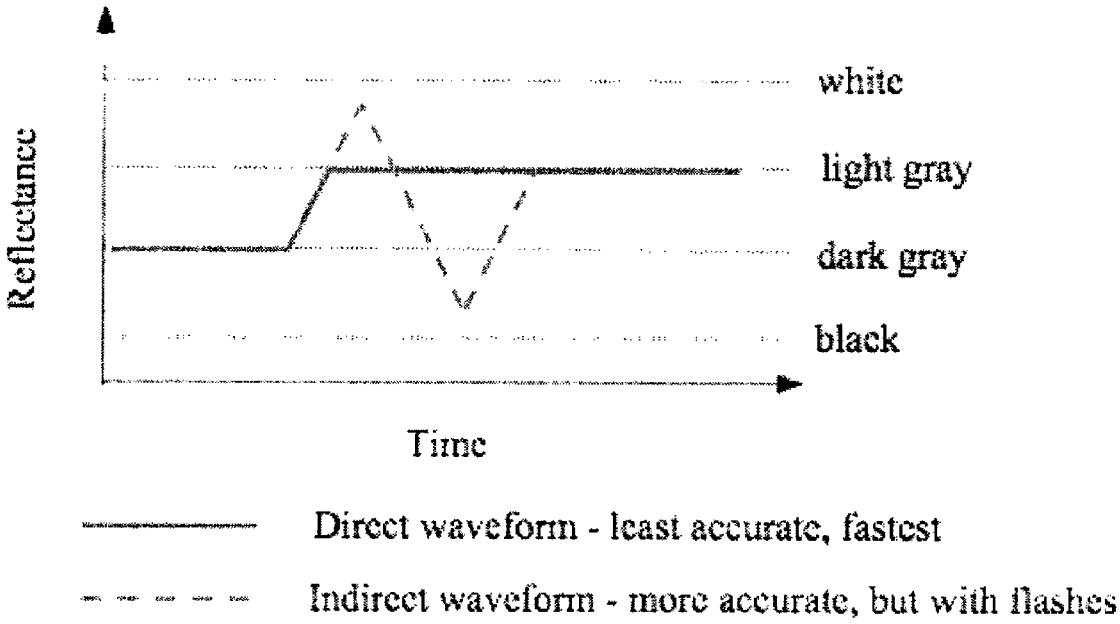
FIG. 3 illustrates waveforms for transition from dark gray to light gray.

An image processing method for reducing imaging artifacts on bistable displays (e.g., electrophoretic displays) is described. These artifacts may be due to ghosting. In one embodiment, imaging artifacts are reduced by performing halftoning on images (e.g., a grayscale image) that are to be displayed by taking into account the previously displayed images. In one embodiment, each input image is converted to a dithered output image for display by using an image sequence correlated error diffusion algorithm described herein.

In one embodiment, error diffusion is used for halftoning, and the error diffusion algorithm takes into account each previous output pixel along with the current output pixel. The predicted display error of each gray level transition is included into the feedback loop of the error diffusion filter. In one embodiment, the display error for each gray level state transition, which is fed into the error diffusion feedback loop, is generated using a look-up table of display errors for each pair of transition states.

Note that the techniques described herein do not rely on predicting the electro-optic model of electronic ink displays, nor do they highly depend on the advanced waveform design, which means that the criteria for waveform optimization could be largely relaxed by applying the proposed image processing approach.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; electrical, optical, acoustical or other form of propagated signals (e.g., carrier waves, infrared signals, digital signals, etc.); etc.

Overview of Image Sequence Correlated Halftoning

One embodiment of the present invention described herein reduces artifacts on bistable displays using an image sequence correlated halftoning technique. The bistable displays include electrophoretic displays and cholesteric liquid crystal displays.

In one embodiment, the halftoning technique is implemented using error diffusion; however, any halftoning method could be used, including, but not limited to, ordered dithering. In one embodiment, the error diffusion algorithm incorporates the use (and impact) of display quantization errors.

Figure 4A:
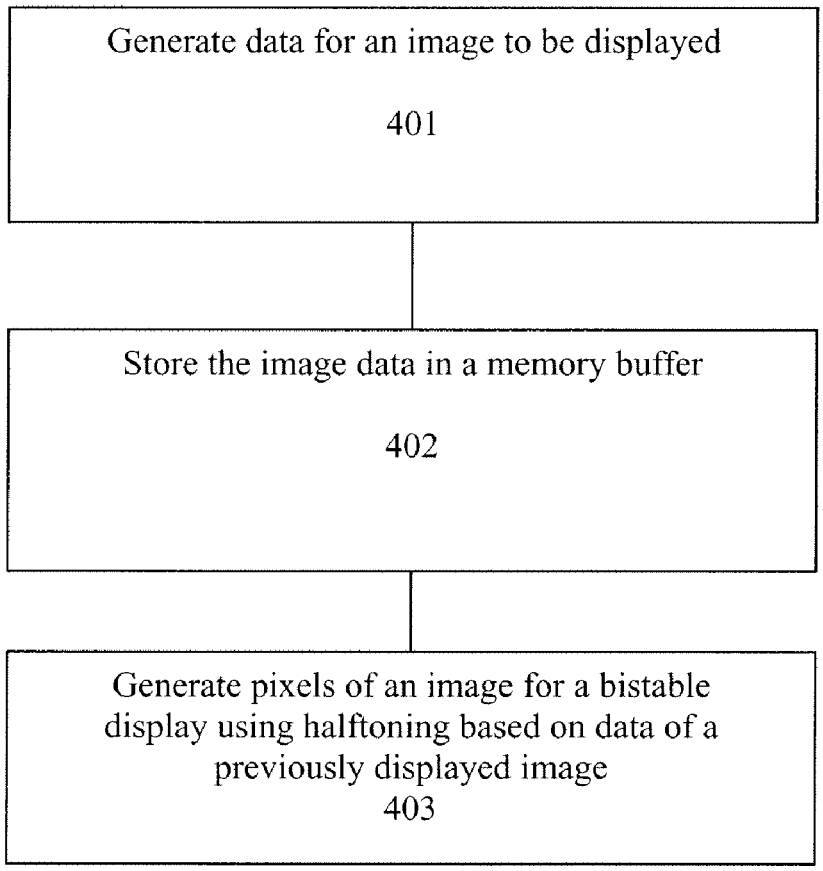
FIG. 4A is a flow diagram of one embodiment of a process for processing an image with halftoning using previously processed image data.

FIG. 4A is a flow diagram of one embodiment of an image processing process. The process is performed by processing logic that may comprise hardware (e.g., circuitry, dedicated logic, etc.), software (such as is run on a general purpose computer system or a dedicated machine), or a combination of both.

Referring to FIG. 4A, the process begins by generating data for an image to be displayed (processing block 401). In one embodiment, the data for the image is generated using one or more image processing operations. In one embodiment, the bistable display comprises an electrophoretic display. In one embodiment, the image data is for a grayscale image.

Next, processing logic optionally stores the image data in a memory buffer (processing block 402).

Once the image data is available, processing logic generates pixels of an image for a bistable display using halftoning based on data of a previously displayed image (processing block 403). In one embodiment, processing logic generates pixels of the image by converting image data to a dithered output image and using the dithered output image as part of a halftoning process applied to an immediately preceding displayed image. In one embodiment, the halftoning process comprises error diffusion.

In one embodiment, the error diffusion incorporates display quantization errors. In one embodiment, the error diffusion modifies input image data using an output from an error diffusion filter that is responsive to an input error for each pixel that is based on a display quantization error associated with said each pixel. In one embodiment, the input error is based on a gray level quantization error and the display quantization error is generated using a lookup table (LUT) of display quantization errors. In one embodiment, generating pixels of an image for a bistable display using halftoning based on data of a previously displayed image includes generating the display quantization error using the LUT having inputs of a pixel value of a previously displayed image and a dithered output image.

In one embodiment, the error diffusion process applies filters for gray level quantization error and display quantization error separately. In this case, generating pixels of an image for a bistable display using halftoning based on data of a previously displayed image includes generating the display quantization error using the LUT having inputs of a pixel value of a previously displayed image and a dithered output image.

In one embodiment, a predicted display quantization error for each gray level transition is included into a feedback loop of an error diffusion filter.

Figure 4B:
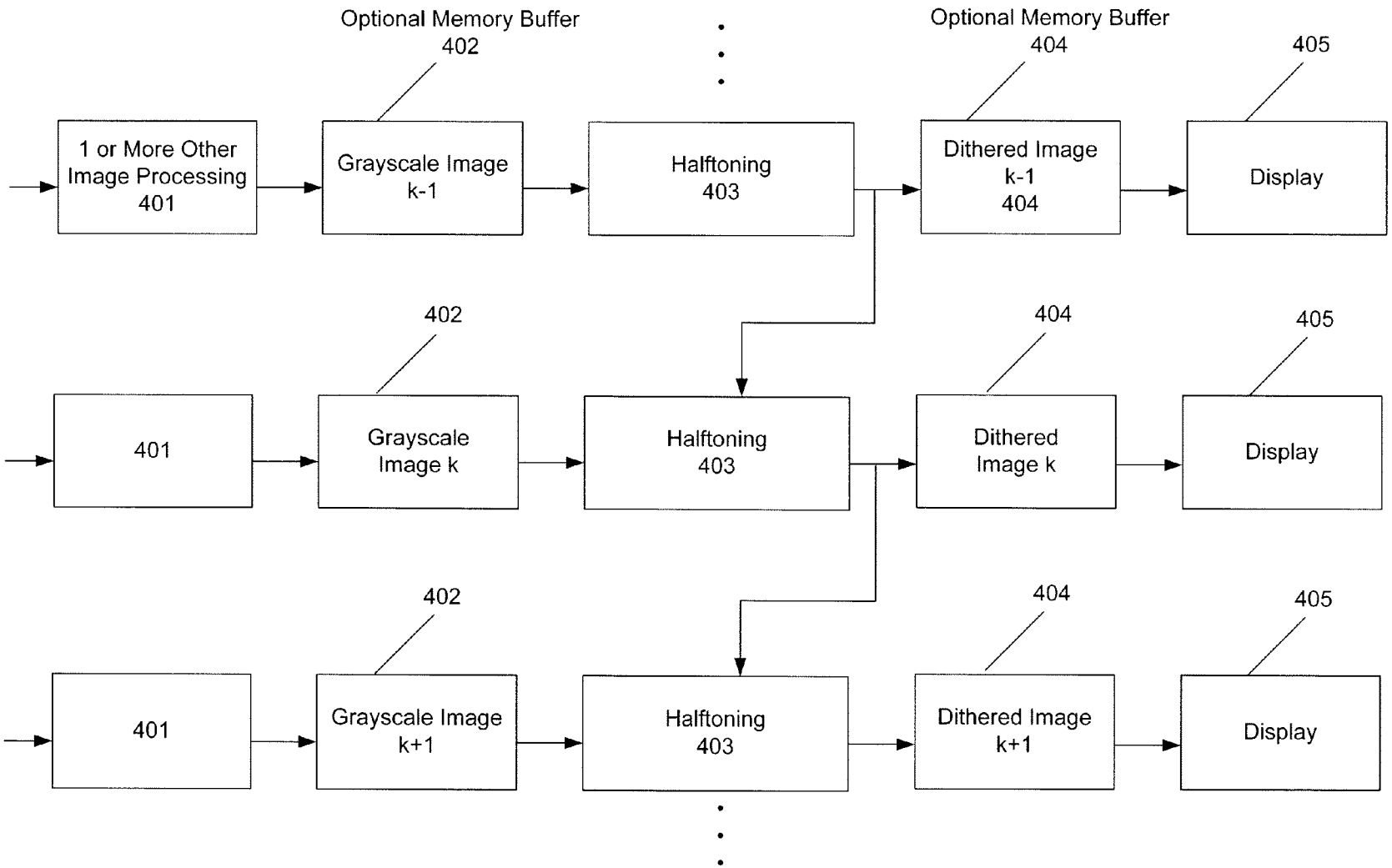
FIG. 4B is a data flow diagram of one embodiment of an architecture for image sequence correlated halftoning.

FIG. 4B is a data flow diagram of one embodiment of an image processing architecture for performing image sequence correlated halftoning. In image sequence correlated halftoning, each grayscale input image is halftoned prior to being displayed, and the output halftone image is used as an input of the halftoning process for the next image. In one embodiment, the halftoning process is a black and white algorithm. In another embodiment, the halftoning process is a multi-bit algorithm.

Each of the processing blocks in FIG. 4B comprises processing logic which may comprise hardware (e.g., circuitry, dedicated logic, etc.), software (such as is run on a general purpose computer system or a dedicated machine), or a combination of both.

Referring to FIG. 4B, one or more optional image processing blocks 401 generates a gray scale image k−1, which is optionally stored in a buffer memory 402. Halftoning block 403 performs halftoning on the gray scale image k−1 based on previous image data to create dithered image k−1. Dithered image k−1 also may be optionally stored in buffer memory 404. Dithered image k−1 is then sent to display 405. Dithered image k−1 is also fed back into halftoning block 403 for use in halftoning of gray scale image k to produce dithered image k which, in turn, is fed back to halftoning block 403 for use in performing halftoning on gray scale image k+1 to create dithered image k+1. The process repeats for all subsequent images.

Images k−1, k and k+1, etc. may be a sequence of frames of the same media. In such a case, frame-to-frame halftoning is performed using the process described herein.

Figure 5:
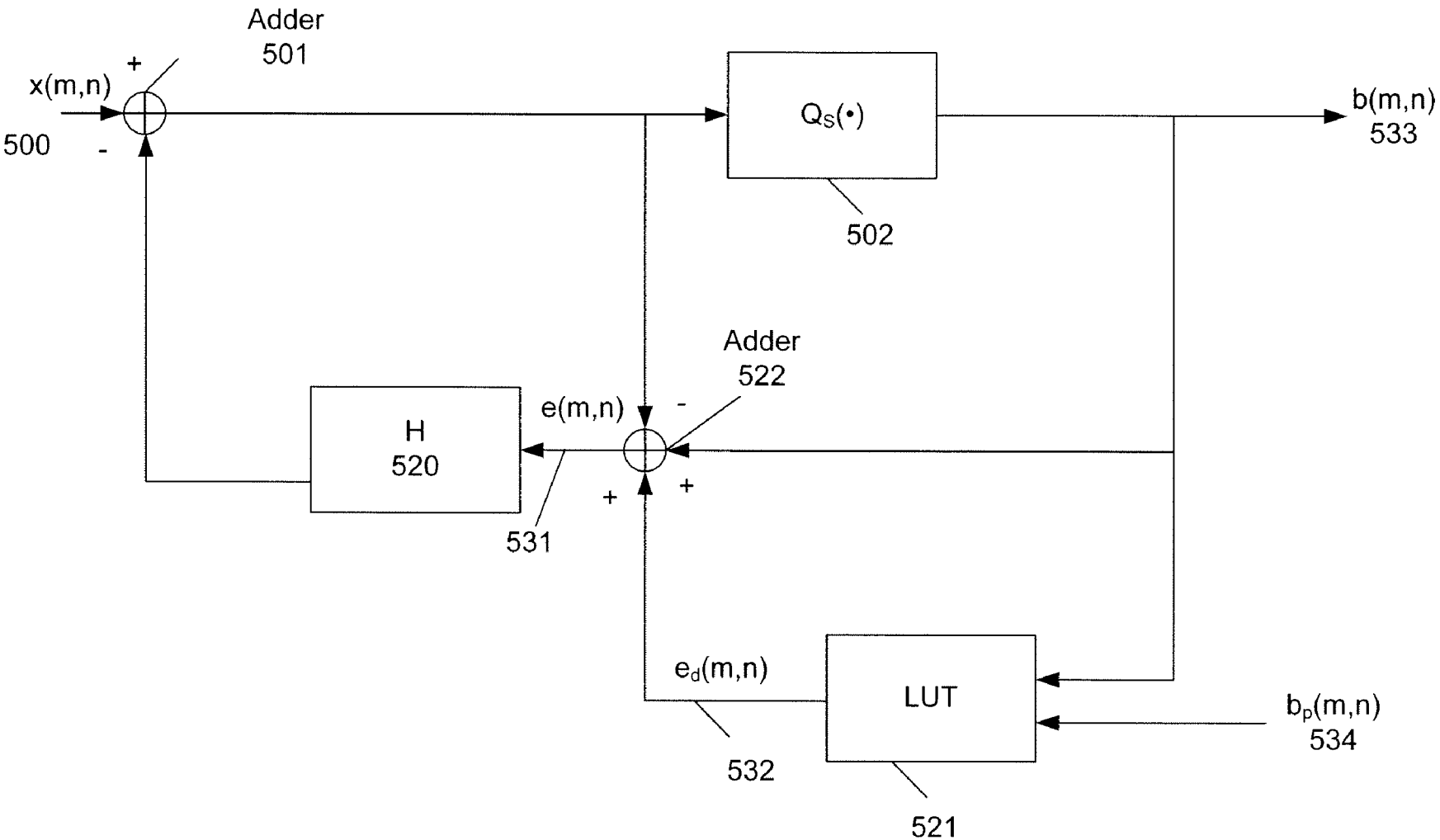
FIG. 5 is a block diagram of one embodiment of an error diffusion module incorporating a look-up table (LUT) of display quantization error.

FIG. 5 is a block diagram of one embodiment of halftoning block 403. As set forth, halftoning block 402 performs error diffusion that incorporates a look-up table of display quantization errors. The error diffusion algorithm includes a look-up table in the feedback loop, where the inputs of the look-up table (LUT) are the previously displayed pixel value, $b_p(m,n)$, and the current output pixel value b(m,n) at location (m,n), and the output of the LUT is the display error in lightness, $e_d(m,n)$, of the current output pixel. The display error is added to the feedback loop of the error diffusion filter (referred to as H here) along with the gray level quantization error caused by the quantizer with quantization function $Q_s$.

Referring to FIG. 5, the blocks are implemented with processing logic which may comprise hardware (e.g., circuitry, dedicated logic, etc.), software (such as is run on a general purpose computer system or a dedicated machine), or a combination of both. Also, the processing is shown per pixel is described in terms of one pixel value. However, it would be apparent to one skilled in the art that processing of this is applied to multiple pixels if not all pixels in an image.

More specifically, pixel value x(m,n) 501 is input into adder 501 which subtracts the output of error diffusion filter 520 to produce a modified input pixel value that is input to quantizer 502, which performs quantizer function $Q_s$. The modified input pixel value is also input (for subtraction) to adder 522. The quantizer 502 performs quantization to produce the output pixel b(m,n) 533. In one embodiment, the quantizer function may perform color quantization producing 256 possible colors of the pixel value to 16 colors. The output of quantization block 502 is input to adder 522 as well as look-up table (LUT) 521.

LUT 521 contains display quantization errors and generates a display quantization error $e_d(m,n)$ 532 in response to the output of quantizer 522 and a pixel value of a previous image $b_p(m,n)$ 534. Essentially, the display error is a type of quantization error that is caused by the limited impulse width resolution of electronic ink display as described above. This display quantization error has different characteristics from the gray level quantization error produced by application of the quantization function $Q_s$.

In one embodiment, the same error diffusion filter parameters are used for both the gray level quantization error and the display quantization error. That is, adder 522 adds the display quantization error $e_d(m,n)$ 532 to the output of quantizer, b(m,n) 533, and subtracts the updated pixel value that output from adder 501 to produce the error value e(m,n) 531. The error value e(m,n) 531 is input into error diffusion filter 520. In response to error value e(m,n) 531, error diffusion filter 520 generates the value that is input to adder 501 for subtraction from input pixel based on the error value, e(m,n) 531, received from matter 522.

Note that the display errors can be determined through a series of tests in a various different ways. In one embodiment, the display errors in the look up table can be determined by performing a series of tests on the display panels. In one embodiment, a high resolution camera is fixed on top of the display panel to be tested, and a test program is used to automatically control the snap shots of the camera and grab the captured image data for each display update. Two sets of test grayscale images are used for the test. One set includes single color blank images of each intermediate gray level, and another set includes two-color images of each intermediate gray level pair with some specific pattern (e.g. two colors in alternative bands). In each test, the test program first executes the display update for a two-color test image input, and then performs a halftoning process shown in FIG. 5 on a single color test image followed by a display update. The corresponding display error in the look up table is adjusted by evaluating the uniformity of the captured image on the display panel for the dithered single color test image output. This closed loop test process can be repeatedly performed for finding the best approximate value for each display error entry in the look up table.

Figure 6:
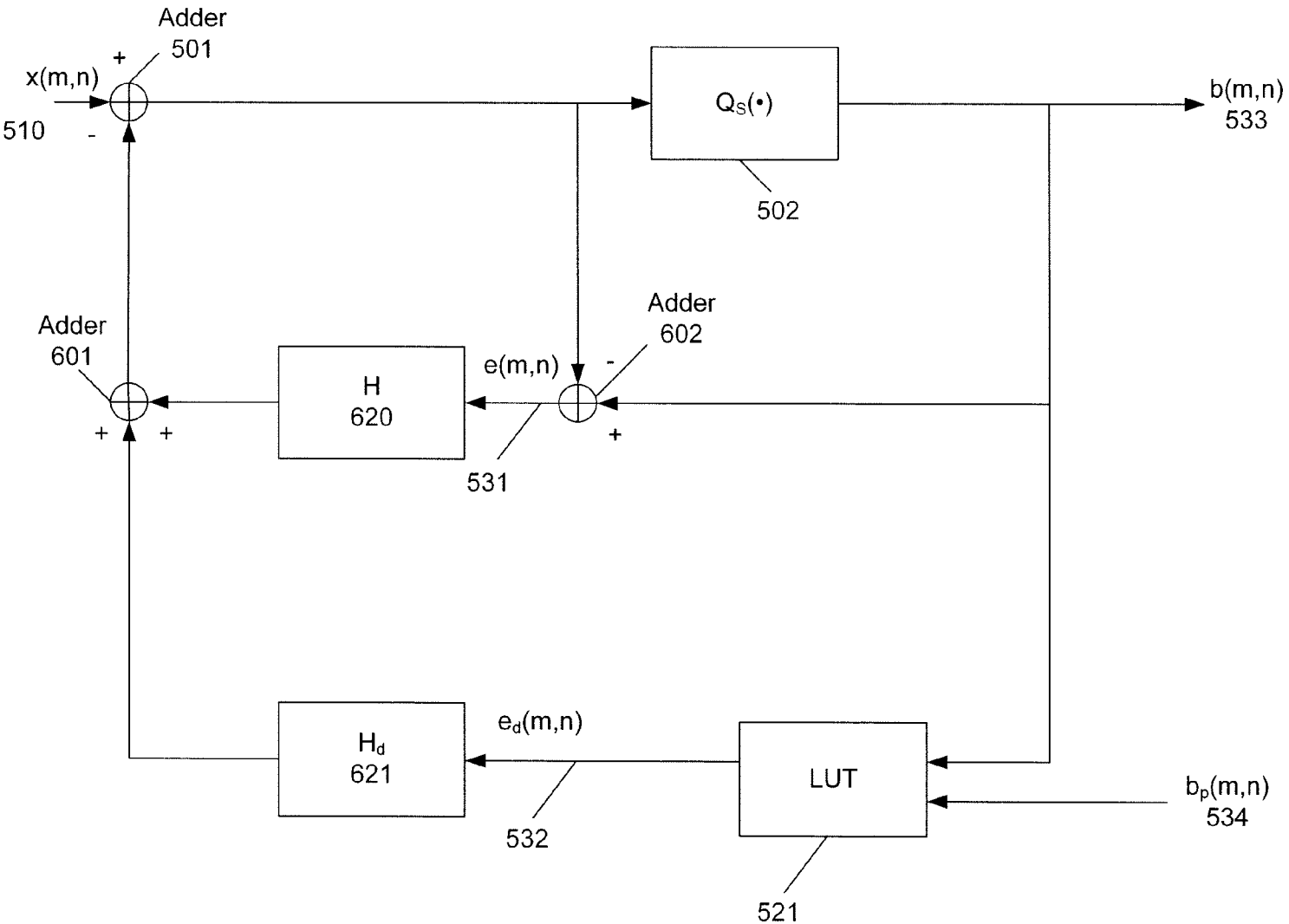
FIG. 6 is a block diagram of another embodiment of an error diffusion module that includes a separate diffusion filter for display quantization error.

In another embodiment, the gray level quantization error and the display quantization error are separately fed into two different error diffusion filters. This is particularly useful where the two types of quantization errors have different characteristics. FIG. 6 is similar to the halftoning arrangement shown in FIG. 5 except in the implementation of the error diffusion algorithm, where $H_d$ is the display quantization error diffusion filter 621, and H is the conventional error diffusion filter 620. In one embodiment, $H_d$ shares the same linear features as H, but may have different error diffusion weights. Referring to FIG. 6, the other differences with respect to FIG. 5 are the inclusion of an additional adder, adder 601, that adds the outputs of display quantization error diffusion filter 621 and error diffusion filter 620. Display quantization error diffusion filter 621 generates its output in response to $e_d(m,n)$ 532, which is output from LUT 521, while error diffusion filter 620 generates its output in response to e (m,n) 532, which is the result of adder 602 subtracting the output of adder 501 from the output of quantizer 502, namely b(m,n) 533.

Also note that the halftoning filters (e.g., the error diffusion filters) as well as the quantization error diffusion filters described herein may be implemented with currently available filters that are well-known in the art. In one embodiment, the error diffusion filter H is as follows:

$$\frac{1}{16}\begin{bmatrix} 0 & 0 & 0 \\ 0 & 0 & 7 \\ 3 & 5 & 1 \end{bmatrix}$$

For other examples, see R. W. Floyd, L. Steinberg, *An Adaptive Algorithm for Spatial Grey Scale*. Proceedings of the Society of Information Display 17, 7577 (1976).

Figure 7:
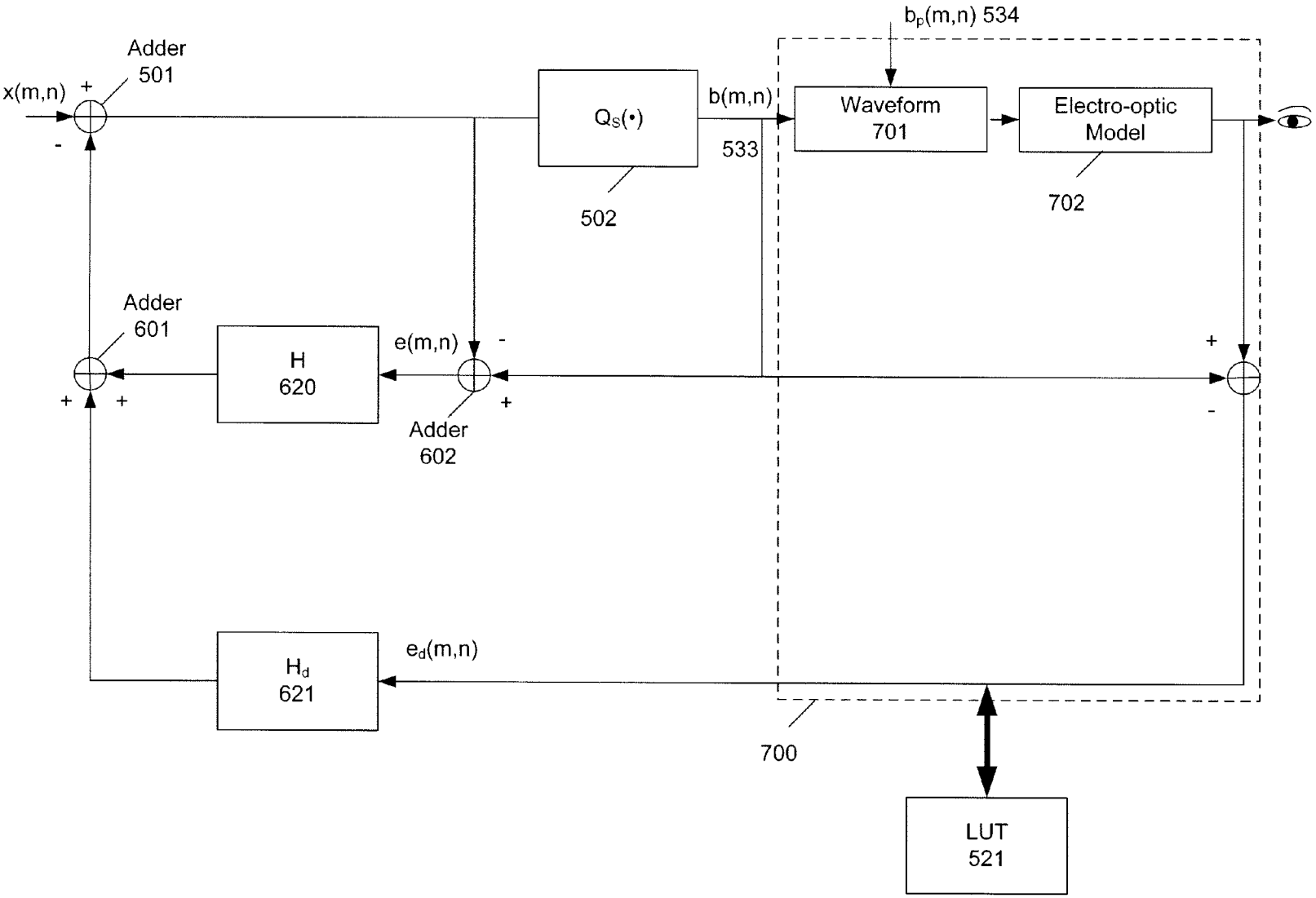
FIG. 7 is a block diagram illustrating display quantization error modeling.

As another illustration, FIG. 7 shows a simple modeling diagram of the display quantization error along with the error diffusion algorithm described in FIG. 6. Referring to FIG. 7, block 700 illustrates the model of the display quantization error. In this model, waveform module 701 receives the previous pixel output value and current pixel output value as inputs and uses them as index to a waveform look-up table to obtain a sequence of driving pulses. Then the driving pulses are applied to the display panel to create desired reflectance. An electro-optic model module 702 is used to represent the characteristic of electronic ink. For simplicity, the human visual system (HVS) is not considered in this modeling. As mentioned above, the display quantization error model can be measured and represented in LUT 521 (shown in FIG. 7). In one embodiment, the number of entries of LUT 521 is small for current electronic ink displays. For example, for a 4-bit device, only 256 entries are needed for LUT 521.

Based on previous study, the impulse response (i.e. reflectance vs. impulse width) of electronic ink is approximately linear for each gray level state transition in a fixed time period. This feature simplifies the display quantization error modeling, which implies the low complexity of the display quantization error diffusion filter design.

There are a number of advantages associated with the image processing techniques described above. For example, in one embodiment, the image processing techniques described above do not rely on predicting the electro-optical model of electronic displays, are robust in that the error diffusion algorithm retains the stability features of the conventional error diffusion algorithms, and can provide high accuracy gray level rendering on the electronic displays. In one embodiment, the image processing techniques are advantageous in that the look-up table of display quantization error can be easily measurable. Note also that embodiments of the image processing techniques are computationally efficient and require low memory usage.

ALTERNATIVE EMBODIMENTS

In one embodiment, the error diffusion technique set forth above is extended to incorporate the future image sequence if available or predictable. The error diffusion algorithm described above in FIGS. 4-7 only uses the past image sequence as input. In some particular applications (e.g., image browsing, multi-page flipping), the future images sequence for display may be available or predictable. In these cases, the error diffusion technique described above is extended to include both the past and the future image sequence into the error diffusion feedback loop. This extended approach can achieve better gray level rendering and higher image quality.

Figure 8:
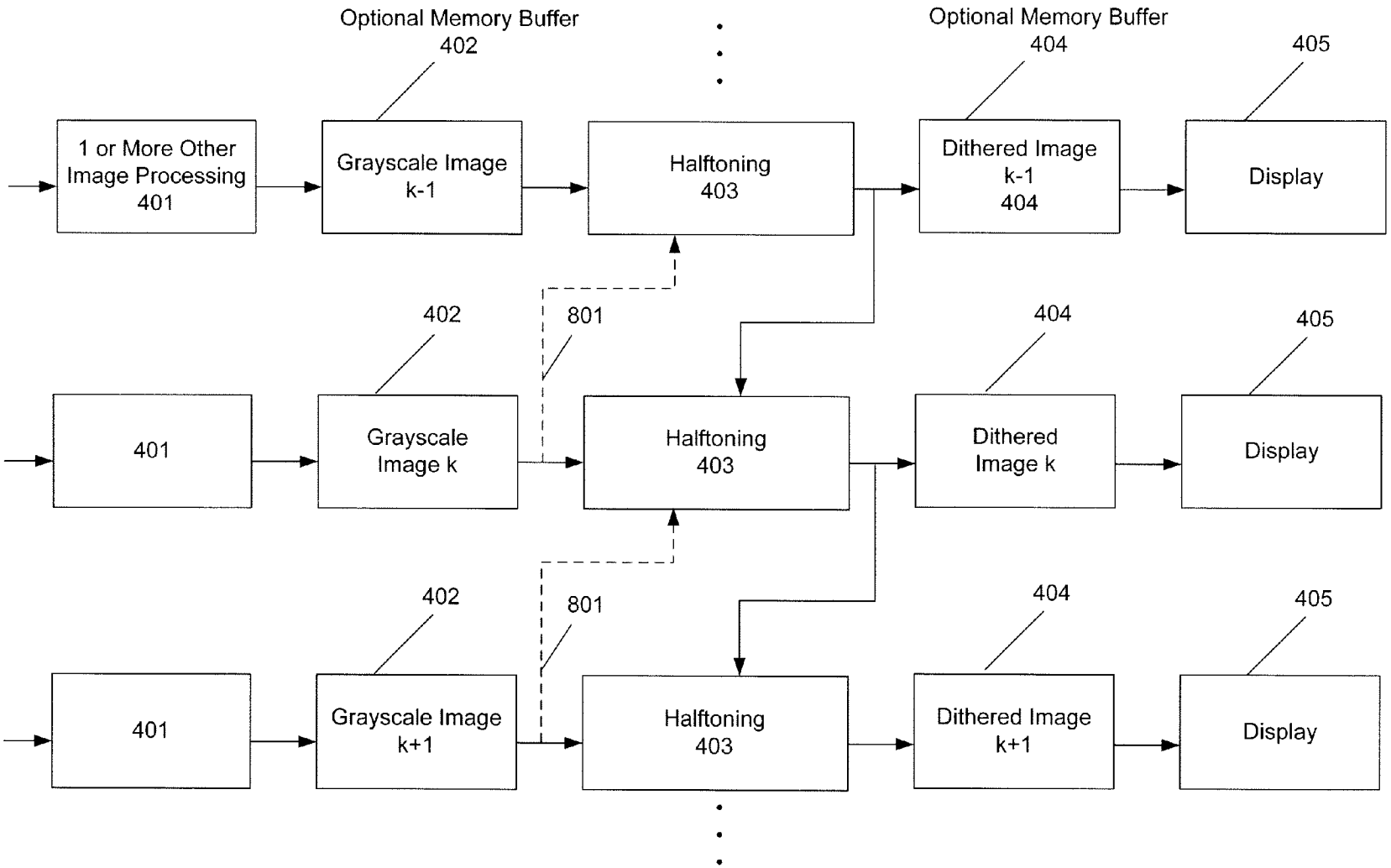
FIG. 8 is a data flow diagram of an alternative embodiment of an architecture for image sequence correlated halftoning.

FIG. 8 is a block diagram of an alternative embodiment of an image processing architecture for performing image sequence correlated halftoning in which the future images in a sequence are used in the error diffusion. FIG. 8 illustrates a substantially similar framework to FIG. 4, with the exception includes lines 801. Referring to FIG. 8, the next grayscale image to undergo halftoning is also provided to halftoning block 403 for use in the halftoning process on the previous gray scale image. For example, gray scale image k is fed into halftoning block 403 for use in the halftoning process applied to grayscale image k−1, as shown with line 801.

In another embodiment, the techniques described above may be extended to color electronic displays. More specifically, in one embodiment, vector-based error diffusion can be used in the same framework as shown in FIG. 4, except that display error measurements are used for all color channels (e.g., RGB).

In yet another embodiment, the error diffusion algorithm described above is replaced with other halftoning algorithms such as, for example, but not limited to, ordered dithering, blue noise mask, etc. The image sequence correlated halftoning approach described above works with other halftoning algorithms. For example, in one embodiment, when computation cost is constrained, and high quality image rendering is not necessary, digital screening algorithms is used for halftoning. However, in this case, since there is no feedback loop to include the look-up table, the display quantization error is only added to the input of the halftoning algorithm. Therefore, this approach may not achieve the similar accuracy to the error diffusion algorithm.

An Example of a Computer System

Figure 9:
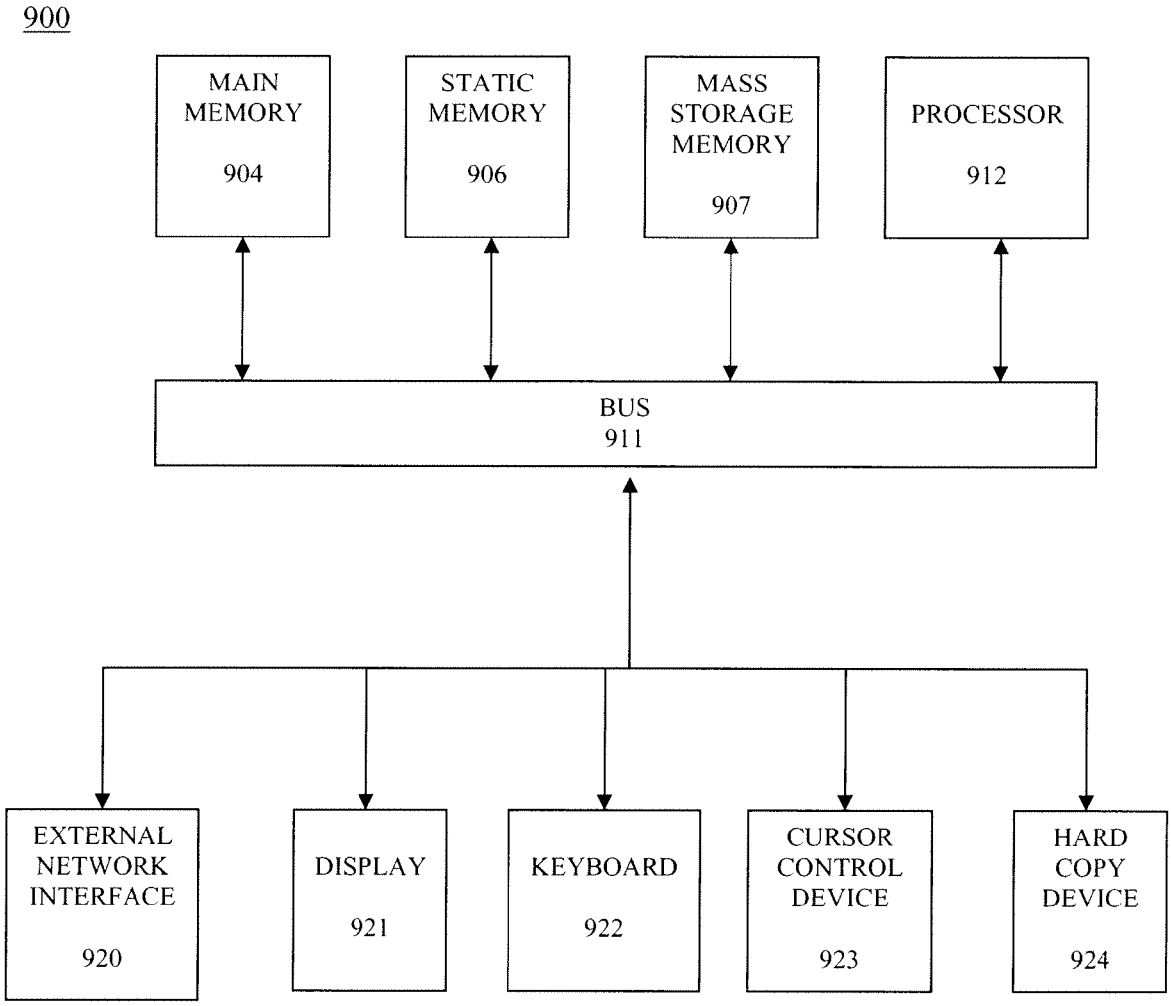
FIG. 9 is a block diagram of one embodiment of a computer system.

FIG. 9 is a block diagram of an exemplary computer system that may perform one or more of the operations described herein. Referring to FIG. 9, computer system 900 may comprise an exemplary client or server computer system. Computer system 900 comprises a communication mechanism or bus 911 for communicating information, and a processor 912 coupled with bus 911 for processing information. Processor 912 includes a microprocessor, but is not limited to a microprocessor, such as, for example, Pentium™, PowerPC™, Alpha™, etc.

System 900 further comprises a random access memory (RAM), or other dynamic storage device 904 (referred to as main memory) coupled to bus 911 for storing information and instructions to be executed by processor 912. Main memory 904 also may be used for storing temporary variables or other intermediate information during execution of instructions by processor 912.

Computer system 900 also comprises a read only memory (ROM) and/or other static storage device 906 coupled to bus 911 for storing static information and instructions for processor 912, and a data storage device 907, such as a magnetic disk or optical disk and its corresponding disk drive. Data storage device 907 is coupled to bus 911 for storing information and instructions.

Computer system 900 may further be coupled to a display device 921, such as a cathode ray tube (CRT) or liquid crystal display (LCD), coupled to bus 911 for displaying information to a computer user. An alphanumeric input device 922, including alphanumeric and other keys, may also be coupled to bus 911 for communicating information and command selections to processor 912. An additional user input device is cursor control 923, such as a mouse, trackball, trackpad, stylus, or cursor direction keys, coupled to bus 911 for communicating direction information and command selections to processor 912, and for controlling cursor movement on display 921.

Another device that may be coupled to bus 911 is hard copy device 924, which may be used for marking information on a medium such as paper, film, or similar types of media. Another device that may be coupled to bus 911 is a wired/wireless communication capability 925 to communication to a phone or handheld palm device.

Note that any or all of the components of system 900 and associated hardware may be used in the present invention. However, it can be appreciated that other configurations of the computer system may include some or all of the devices.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

I claim:

1. A method comprising:

generating pixels of an image for a bistable display using halftoning based on data of one or more previously displayed images, wherein generating the pixels comprises:

generating a first output in response to a gray level quantization error;

generating a second output for each pixel in response to an error value that is based on a display quantization error associated with said each pixel;

adding the first and second outputs to create a third output; and subtracting the third output from input image data.

2. The method defined in claim 1 wherein generating pixels of the image comprises converting image data to a dithered output image and using the dithered output image as part of a halftoning process applied to an immediately preceding displayed image.

3. The method defined in claim 2 wherein the halftoning process comprises error diffusion.

4. The method defined in claim 3 wherein the error diffusion incorporates display quantization errors.

5. The method defined in claim 4 wherein the error diffusion modifies input image data using an output from an error diffusion filter that is responsive to the input error for each pixel that is based on the display quantization error associated with said each pixel.

6. The method defined in claim 5 wherein the input error is based on the gray level quantization error.

7. The method defined in claim 5 wherein the display quantization error is generated using a lookup table (LUT) of display quantization errors.

8. The method defined in claim 7 further comprising generating the display quantization error using the LUT having inputs of a pixel value of a previously displayed image and a dithered output image.

9. The method defined in claim 3 further comprising wherein the image sequence correlated error diffusion applies filters for the gray level quantization error and the display quantization error separately.

10. The method defined in claim 9 further comprising generating the display quantization error using the LUT having inputs of a pixel value of a previously displayed image and a dithered output image.

11. The method defined in claim 1 wherein a predicted display error for each gray level transition is included into a feedback loop of an error diffusion filter.

12. The method defined in claim 1 wherein the image comprises a grayscale image.

13. The method defined in claim 1 wherein the bistable display comprises an electrophoretic display.

14. The method defined in claim 1, wherein generating the pixels comprises:

generating the display quantization error using a previously displayed image and an output of a quantizer; and applying one or more filters to the gray level quantization error incurred by the quantizer and the display quantization error to generate a modification to the input image data.

15. An article of manufacture having one or more computer-readable storage media storing instructions thereon which, when executed by a system, cause the system to perform a method comprising:

generating pixels of an image for a bistable display using halftoning based on data of one or more previously displayed images, wherein generating the pixels comprises:

generating a first output in response to a gray level quantization error;

generating a second output for each pixel in response to an error value that is based on a display quantization error associated with said each pixel;

adding the first and second outputs to create a third output; and subtracting the third output from input image data.

16. The article of manufacture defined in claim 15 wherein generating pixels of the image comprises converting image data to a dithered output image and using the dithered output image as part of a halftoning process applied to an immediately preceding displayed image.

17. The article of manufacture defined in claim 16 wherein the halftoning process comprises error diffusion that incorporates display quantization errors.

18. The article of manufacture defined in claim 17 wherein the error diffusion modifies input image data based on an output of an error diffusion filter generated responsive to the input error for each pixel that is based on the display quantization error associated with said each pixel.

19. The article of manufacture defined in claim 17 wherein the display quantization errors are generated using a lookup table (LUT) of display quantization errors.

20. The article of manufacture defined in claim 15 wherein generating pixels of the image further comprising:

generating the display quantization error using a previously displayed image and an output of a quantizer; and applying one or more filters to the gray level quantization error incurred by the quantizer and the display quantization error to generate a modification to the input image data.

21. An apparatus comprising:

a memory to store image data;

a halftoning unit coupled to the memory to receive the image data and to generate pixels of an image for a bistable display using halftoning based on data of one or more previously displayed images, wherein the halftoning unit comprises a halftoning filter to generate a first output in response to a gray level quantization error, and further comprising:

an error diffusion filter to generate a second output for each pixel in response to an error value that is based on a display quantization error associated with said each pixel;

an adder to add the first and second outputs to create a third output; and a subtractor to subtract the third output from input image data.

22. The apparatus defined in claim 21 further comprising a LUT to generate the second output in response to inputs of a pixel value of a previously displayed image and a dithered output image.

23. The apparatus defined in claim 21 wherein a predicted display error for each gray level transition is included into a feedback loop of an error diffusion filter.

24. The apparatus defined in claim 21 wherein the image comprises a grayscale image.

25. The apparatus defined in claim 21 wherein the bistable display comprises an electrophoretic display.

26. The apparatus defined in claim 21, wherein the halftoning unit is adapted to generate the display quantization error using a previously displayed image and an output of a quantizer, wherein the halftoning unit comprises one or more filters that filter the gray level quantization error incurred by the quantizer and the display quantization error to generate a modification to the input image data.

27. The apparatus defined in claim 21 wherein the halftoning unit converts the image data to a dithered output image and using the dithered output image as part of a halftoning process applied to an immediately preceding displayed image.

28. The apparatus defined in claim 27 wherein the halftoning process comprises an error diffusion module.

29. The apparatus defined in claim 28 wherein the error diffusion module incorporates display quantization errors.

30. The apparatus defined in claim 29 wherein the error diffusion module comprises:

the error diffusion filter; and the substractor.

31. The apparatus defined in claim 30 wherein the error value for each pixel is based on the gray level quantization error.

32. The apparatus defined in claim 30 further comprising a lookup table (LUT) of display quantization errors coupled to the error diffusion filter to output the display quantization error for said each pixel in response to a pixel value from a previously displayed image and a corresponding pixel value of a currently displayed image.

* * * * *